US010220267B2

(12) United States Patent
Holtzman

(10) Patent No.: US 10,220,267 B2
(45) Date of Patent: Mar. 5, 2019

(54) SHAFT ADAPTER ROTATOR

(71) Applicant: Barry Lyn Holtzman, Eagle River, WI (US)

(72) Inventor: Barry Lyn Holtzman, Eagle River, WI (US)

( * ) Notice: Subject to any disclaimer, the term of this patent is extended or adjusted under 35 U.S.C. 154(b) by 0 days.

(21) Appl. No.: 15/530,550

(22) Filed: Jan. 27, 2017

(65) Prior Publication Data

US 2018/0214747 A1 Aug. 2, 2018

(51) Int. Cl.
*A63B 53/02* (2015.01)

(52) U.S. Cl.
CPC ..... *A63B 53/02* (2013.01); *A63B 2053/023* (2013.01)

(58) Field of Classification Search
CPC ... A63B 53/02; A63B 53/04; A63B 2053/022; A63B 2053/023; A63B 2053/25; A63B 2053/26; A63B 2053/27; A63B 2053/028
See application file for complete search history.

(56) References Cited

U.S. PATENT DOCUMENTS

| | | | | |
|---|---|---|---|---|
| 2,027,452 | A | 1/1936 | Rusing | |
| 2,067,556 | A | 1/1937 | Wettlaufer | |
| 7,476,160 | B2 | 1/2009 | Hocknell et al. | |
| 7,722,475 | B2 | 5/2010 | Thomas et al. | |
| 8,182,357 | B2 * | 5/2012 | Moore | A63B 53/02 473/246 |
| 8,235,839 | B2 | 8/2012 | Bennett et al. | |
| 8,246,484 | B2 * | 8/2012 | Sato | A63B 53/02 473/307 |
| 8,303,431 | B2 | 11/2012 | Beach et al. | |
| 8,535,173 | B2 | 9/2013 | Golden et al. | |
| 8,574,092 | B2 | 12/2013 | Galloway et al. | |
| 8,727,899 | B1 | 5/2014 | Galloway et al. | |
| 9,033,815 | B2 * | 5/2015 | Sander | A63B 53/02 473/305 |
| 9,168,427 | B1 * | 10/2015 | Aguinaldo | A63B 53/02 |
| 9,174,097 | B1 | 11/2015 | Dacey et al. | |
| 2009/0062029 | A1 * | 3/2009 | Stites | A63B 53/00 473/288 |
| 2013/0102405 | A1 * | 4/2013 | Moore | A63B 53/02 473/246 |

* cited by examiner

*Primary Examiner* — Stephen Blau

(57) ABSTRACT

In a golf club, an apparatus which secures a shaft to a head comprises a rotator, a shaft adapter, a rotator connection mechanism which provides for the rotator be secured to the head in a plurality of rotational orientations, and a shaft adapter connection mechanism which provides for a component of the shaft adapter to be secured to the rotator in a plurality of rotational orientations. Under a condition that the shaft adapter is a skewed axis shaft adapter, the apparatus can be used to make independent adjustments to the head's mass distribution properties and angular orientation with respect to an axis of the shaft. The apparatus is also useful in making adjustments to the golf club's face progression and to the shaft's rotational orientation with respect to the head.

20 Claims, 4 Drawing Sheets

SHAFT ADAPTER ROTATOR

CROSS REFERENCE TO RELATED APPLICATIONS

Not Applicable

FEDERALLY SPONSORED RESEARCH OR DEVELOPMENT

Not Applicable

SEQUENCE LISTING, TABLE, OR PROGRAM

Not Applicable

BACKGROUND

Field

Figure 1:
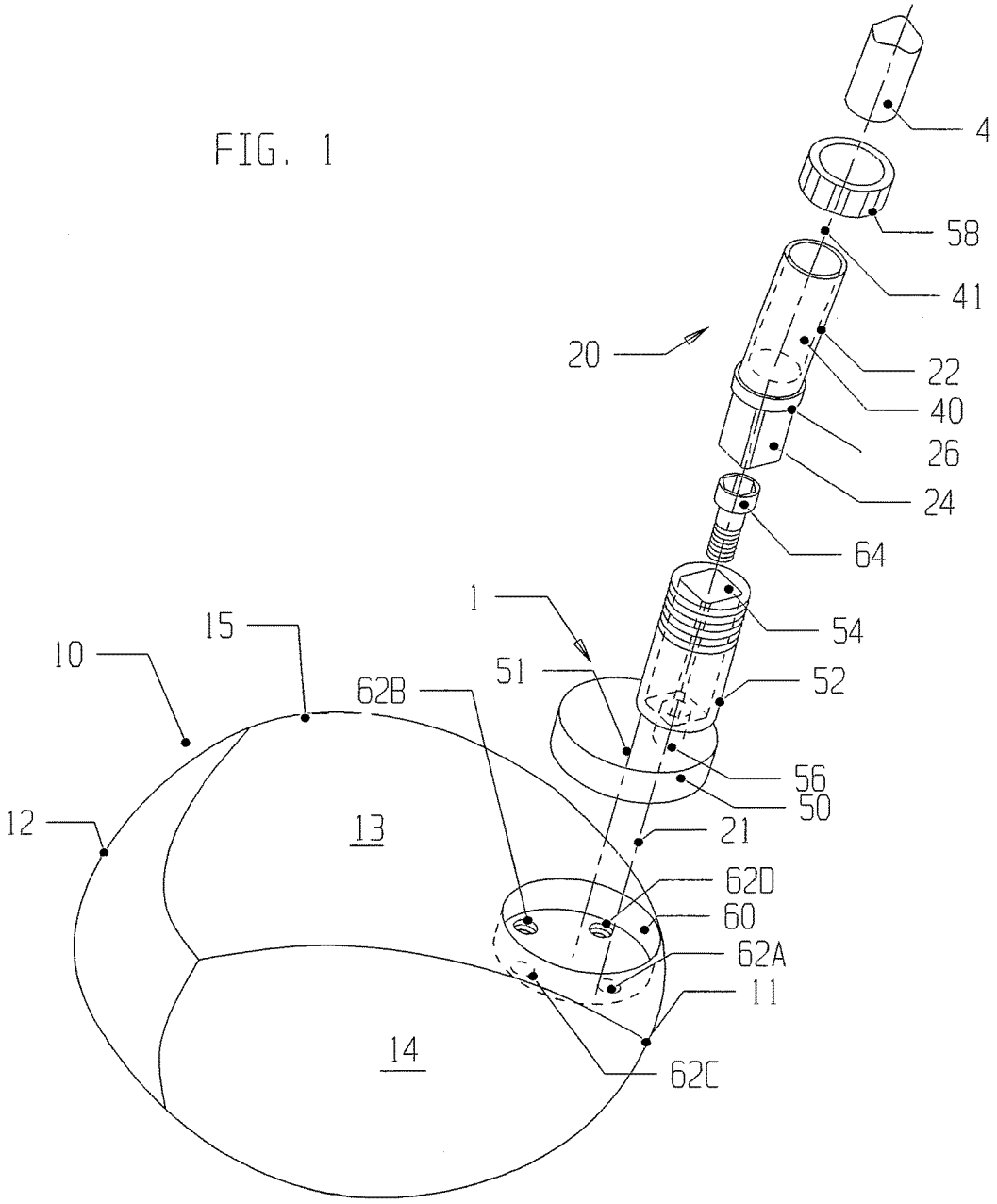

In a golf club, this application relates to an apparatus which secures a shaft to a head, the apparatus comprising a rotator, a shaft adapter, a rotator connection mechanism to secure the rotator to the head, and a shaft adapter connection mechanism to secure the shaft adapter to the rotator.

Prior Art

A golf club has a head, a shaft, and an attachment mechanism for securing the shaft to the head. The head has a face for striking a golf ball, a back which is opposite the face, a bottom surface called a sole, a top surface called a crown, a heel which is its end closest to the golfer, and a toe which is its end farthest from the golfer. Several attributes of a golf club affected by angular, spatial, and rotational relationships between the head and an axis of the shaft are important in this discussion.

A first important attribute is a set of angular properties which include the golf club's loft angle, lie angle, and face angle, and these properties are affected by an angular orientation of the head with respect to the shaft's axis. These properties are normally defined when the head is in a centered, squared, position, or CSP. For the head to be in its CSP, several conditions together must be met. With the shaft's axis lying in a shaft plane which is perpendicular to a ground plane, the centered condition is met if the head's sole touches the ground plane at a point which is centered on the head's face. The squared condition is met if the head's face line, a line defined by two points on the face equally distant horizontally from the face's center and halfway up the face from the ground plane, is parallel to the shaft plane. With the head in its CSP, loft angle is the angle the head's face makes with the shaft plane, lie angle is the angle the shaft's axis makes with the ground plane, and face angle is the angle the face line makes with the shaft plane which is zero if the head is in its CSP.

A second important attribute is a set of spatial properties including a property called face progression. Face progression is a horizontal distance, measured perpendicularly to the head's face line, from the shaft's axis to the leading edge of the club when the club is in its CSP.

A third important attribute of a golf club is a set of mass distribution properties of the head with respect to the shaft's axis including its first and second moments of mass. The first moment of mass with respect to the shaft's axis is the head's mass times a length of a line which connects the head's center of mass (COM) perpendicularly to the shaft's axis, this line being a torque arm for the head's COM about the shaft's axis. A torque which is applied to the shaft by swinging the club is affected by this first moment of mass. The head's second moment of mass about the shaft's axis determines, along with a torsional stiffness of the shaft, a torsional frequency of the golf club. Torque and torsional frequency are important considerations in golf club design because they affect an "opening" and "closing" of the head's face with respect to a target line when the club is swung.

A fourth attribute important to this discussion is a rotational orientation of the shaft with respect to the head. Golf shafts typically have asymmetry under rotation about their axes in that they exhibit different characteristics when deflected in planes which lie in different rotational orientations about the axis of the shaft. Some terms used to characterize this asymmetry are "spine", "natural bend point" (NBP), and "flat line oscillation" plane (FLO plane). Because of shaft asymmetry, some believe there are preferred rotational orientations of a shaft with respect to a head, for instance an orientation that places the FLO plane in a perpendicular relationship with the head's face line.

Part of the shaft attachment mechanism is a hosel, a cylindrically shaped bore into which the shaft's tip is secured, typically by using an epoxy bond. The shaft's tip normally has a close-fitting relationship with the hosel, and therefore the shaft's axis and an axis of the hosel are substantially collinear. In these discussions, these axes are assumed to be collinear, so reference to a hosel's axis infers reference to a shaft's axis and vice versa. Several mechanisms for securing the hosel and the shaft to a golf club head have been developed over the years.

In what could be called a "simple hosel", the hosel is located at the top of a tubular neck angling upwardly from the head's crown near its heel. A simple hosel is rigidly fixed to the head and therefore the hosel's axis is fixed with respect to the head. Because of this fixed relationship, a simple hosel in and of itself does not provide for adjustment of any of the attributes discussed above.

Devices commonly called shaft adapters have been developed to secure a shaft to a golf club head. Typical shaft adapters have components including an adapter fitting with an upper portion into which a hosel is bored and a shaft adapter connection mechanism which connects the shaft adapter to the head with one or more of its components in a plurality of rotational orientations. These shaft adapters provide several benefits. A first benefit is an ability to easily change a shaft used with a head. If a golfer has a head he likes but would like to change shafts, instead of the change involving the epoxy bond between the shaft and hosel, he uses the shaft adapter's connection mechanism to interchange shaft adapters and their attached shafts. Considering shaft asymmetry discussed above, a second benefit is an ability, using the shaft adapter's connection mechanism, to position the shaft in a preferred rotational orientation with respect to the head. A third benefit is a potential ability to change the club's angular properties discussed above by changing the angular orientation of the head with respect to the hosel's axis.

Shaft adapters can be categorized into two types which are herein called "straight axis shaft adapters" and "skewed axis shaft adapters". The straight axis shaft adapter has as one component an adapter fitting which has an axis which is collinear with its hosel's axis and with an axis of its connection mechanism in any rotational orientation of the adapter fitting with respect to its connection mechanism. This type of adapter can be used to access the above-mentioned benefits of shaft interchangeability and placement of the shaft in a preferred rotational orientation with respect to the face line of the head but cannot be used to adjust the angular orientation of the head with respect to the hosel's axis. In the skewed axis shaft adapter, one or more components which can be rotated with respect to its connection mechanism cause its hosel's axis to be skewed (not parallel) with respect to an axis of its connection mechanism. The skewed axis shaft adapter can be provide all three benefits discussed above. Most skewed axis shaft adapters currently in use can be categorized into two types which are herein called "skewed fitting" shaft adapters and "skewed shim" shaft adapters.

In the skewed fitting shaft adapter, the component which causes its hosel's axis to be skewed with respect to an axis of its connection mechanism is its adapter fitting. The adapter fitting has a lower portion with an axis which is a first part of its connection mechanism and an upper portion with a hosel having an axis which is skewed with respect to the axis of its lower portion. A second part of the connection mechanism is a socket in the head and a third part is a fastener which secures the adapter fitting in the socket. The component which can be placed in various rotational orientations with respect to an axis of the connection mechanism is the adapter fitting, and normally an indexing mechanism, such as an interlocking spline and groove mechanism, can lock it in a plurality of indexed rotational orientations. The socket has an axis and it is substantially collinear with the axis of the adapter fitting's lower portion. But since the hosel's axis is skewed with respect to the axis of the adapter fitting's lower portion, as the adapter fitting is rotated in the socket, the hosel's axis follows a substantially cone-shaped surface and the angular orientation of the head with respect to the hosel's axis will change. An example of a skewed fitting shaft adapter is presented in U.S. Pat. No. 8,303,431 by Beach et al.

In the skewed shim shaft adapter, one component is an adapter fitting with a lower portion which is a first part of its connection mechanism and an upper portion with a hosel having an axis which is collinear with an axis of the lower portion. A second part of the connection mechanism is a socket in the head and a third part is a fastener which secures the adapter fitting in the socket. This type of adapter uses one or more annularly shaped shims with a non-uniform thickness as the components which skew its hosel's axis with respect to an axis of its connection mechanism. One or more shims are placed between its adapter fitting and an entrance to the socket, thus forcing the hosel's axis to be skewed with respect to an axis of the socket. The adapter fitting, the socket's entrance, and the shim(s) normally have interlocking shapes which provide an indexing mechanism which can rotationally lock the adapter fitting and the shim(s) in a plurality of rotational orientations with respect to the socket's axis. In this type of shaft adapter, a rotation of its skewed shim(s) changes an angle between the hosel's axis and the socket's axis, thereby changing the head's angular orientation with respect to the hosel's axis. An example of a skewed shim shaft adapter which uses a single shim is shown in U.S. Pat. No. 8,535,173 to Golden and Harvell, and an example of one which uses two shims is shown in U.S. Pat. No. 9,174,097 to Dacey et al.

Skewed axis shaft adapters have a "reference axis" as described in U.S. Pat. No. 9,174,097 page 1 line 45. As the adapter fitting of a skewed fitting shaft adapter is rotated in the head's socket, the hosel's axis follows a cone-shaped surface and this cone has an axis of symmetry. The cone's axis and the socket's axis are substantially collinear, and the reference axis is herein indicated as being collinear with these two axes. The cone also has a vertex, and this point can be called the "knee" of the skewed fitting shaft adapter, and this knee is a point at which the shaft's axis in any rotational positioning of the adapter fitting intersects the reference axis. In a typical skewed fitting shaft adapter, its knee lies inside its adapter fitting. These principles are shown in FIG. 69B of U.S. Pat. No. 8,303,431. In the skewed shim shaft adapter, its reference axis is herein indicated as being the axis of the socket in the head. The straight axis shaft adapter, with its collinear hosel axis, fitting axis, and socket axis, has a reference axis which is herein indicated as being collinear with these three axes.

A skewed axis shaft adapter is used in a golf club to adjust the angular orientation of its head with respect to its shaft's axis in order to adjust its angular properties including its loft angle, lie angle, and face angle. Therefore, these adapters are typically limited to an adjustment range of about plus or minus two degrees, meaning an included angle of their conical path is typically less than four degrees. For instance, a typical driver which uses a shaft adapter has a "reference" loft of about 10 degrees, which is its loft if its shaft's axis is collinear with the reference axis of the shaft adapter. It is not normally desirable to have a shaft adapter which can change a driver's actual loft by more than two degrees, plus or minus, from its reference loft, as more change than this and a driver head would not make a driver. Because of this restriction, adjustments to a golf club's angular properties using a skewed axis shaft adapter typically result in relatively small adjustments to a club's spatial and mass distribution properties. Also, these adjustments are not independent. If it is desirable to use a skewed axis shaft adapter to position the shaft's axis to a particular angular orientation with respect to the head, but this positioning does not produce desired spatial and mass distribution properties, this is a problem.

An ability to significantly adjust a golf club's mass distribution properties with respect to its shaft's axis is desirable, especially if this adjustment can be made independently from, but perhaps along with, an adjustment of the angular orientation of the head with respect to the shaft's axis. To this end, head designs have been developed to move a head's COM with respect to the head, and these designs typically use one of two schemes to accomplish this. The first scheme is to provide one or more weight ports in the head in which weights of different mass can be installed. The second scheme is to provide one or more channels in which one or more weights can be slid, either heel-to-toe or face-to-back. These adjustments cause the head's COM to move with respect to the head and therefore with respect to the hosel's axis. These schemes add cost and complexity to a golf club, but are often used along with a skewed axis shaft adapter to provide independent adjustability of the head's mass distribution properties and angular orientation with respect to the hosel's axis.

It is desirable to have an apparatus for securing a shaft to a golf club head which provides independent adjustment of the head's mass distribution properties and angular orientation with respect to an axis of the shaft, as well as adjustment of the shaft's rotational orientation with respect to the head and the club's face progression.

SUMMARY

In a golf club, an apparatus which secures a shaft to a head comprises a rotator, a shaft adapter, a rotator connection mechanism which provides for the rotator be secured to the head in a plurality of rotational orientations, and a shaft adapter connection mechanism which provides for a component of the shaft adapter to be secured to the rotator in a plurality of rotational orientations. Under a condition that the shaft adapter is a skewed axis shaft adapter, the apparatus can be used to make independent adjustments to the head's mass distribution properties and angular orientation with respect to an axis of the shaft. The apparatus is also useful in making adjustments to the golf club's face progression and to the shaft's rotational orientation with respect to the head.

DRAWINGS—FIGURES

Drawings of the present invention are as follows:

FIG. 1 shows an exploded view of a portion of a golf club with a first embodiment of an apparatus used in securing a shaft to a golf club head.

FIGS. 2, 3, 4, and 5 show assembled views of the items shown in FIG. 1 with the shaft secured in a plurality of positions with respect to the head.

Figure 6:
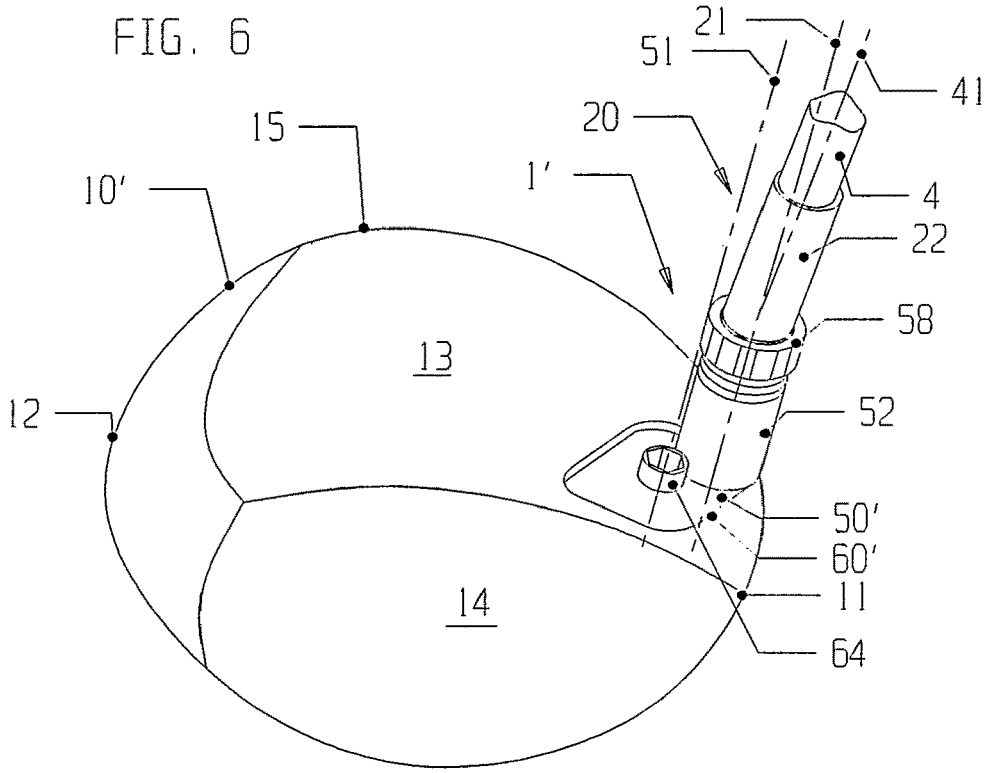
Figure 7:
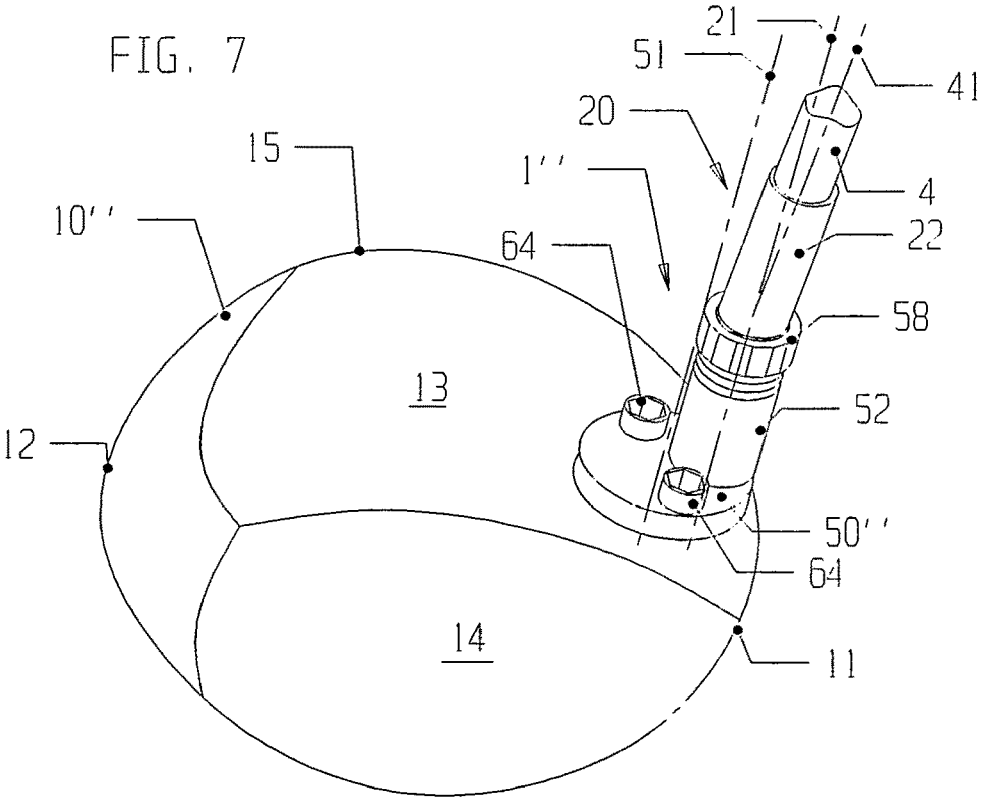

FIGS. 6 and 7 show second and third embodiments of the apparatus.

DRAWINGS—REFERENCE NUMERALS

1 rotator assembly, first embodiment
1' rotator assembly, second embodiment
1" rotator assembly, third embodiment
4 shaft
10 golf club head first embodiment
10' golf club head second embodiment
10" golf club head third embodiment
11 head's heel
12 head's toe
13 head's crown
14 head's face
15 head's back
20 shaft adapter assembly
21 reference axis of shaft adapter assembly
22 adapter fitting
24 lower portion of adapter fitting, indexing
26 shoulder of adapter fitting
40 hosel
41 hosel's axis
50 rotator, first embodiment
50' rotator, second embodiment
50" rotator, third embodiment
51 rotator's axis of rotation
52 externally threaded neck
54 socket, indexing
56 thru hole
58 nut
60 cavity in head, first embodiment
60' cavity in head, second embodiment
62A threaded hole in cavity for rotator heel orientation
62B threaded hole in cavity for rotator toe orientation
62C threaded hole in cavity for rotator face orientation
62D threaded hole in cavity for rotator back orientation
64 fastener for rotator

Description—FIG. 1—Shaft Adapter Rotator, First Embodiment

FIG. 1 shows an exploded view of a portion of a golf club and a first embodiment of an apparatus of this invention, the apparatus comprising a rotator assembly 1 which is used to secure a golf shaft 4 to a club head 10 which has a heel 11, a toe 12, a crown 13, a face 14, and a back 15. The apparatus further comprises a shaft adapter assembly 20, shown here as being a skewed axis shaft adapter of the skewed fitting type and having a reference axis 21, assembly 20 comprising an adapter fitting 22 with a lower 24, a shoulder 26, and a hosel 40 with an axis 41. Rotator assembly 1 comprises a rotator 50 having an axis of rotation 51, an externally threaded neck 52, an indexing socket 54, a thru hole 56, and a nut 58. The apparatus further comprises a cavity 60 located in head 10, a plurality of threaded holes 62A, B, C, and D in cavity 60, and a fastener 64.

Operation—FIGS. 1-5—Shaft Adapter Rotator, First Embodiment

FIG. 1, in an exploded view, shows how the first embodiment of this apparatus secures shaft 4 to head 10. Rotator 50 is secured to head 10 by a rotator connection mechanism comprising a lower portion of rotator 50, cavity 60, four threaded holes 62A-D, and fastener 64. Shaft adapter assembly 20 is secured to rotator 50 by a shaft adapter connection mechanism comprising the lower portion 24 of adapter fitting 22, externally threaded neck 52, socket 54, and nut 58. And finally, shaft 4 is secured in hosel 40 in adapter fitting 22 typically by using an, epoxy bond.

Figure 2:
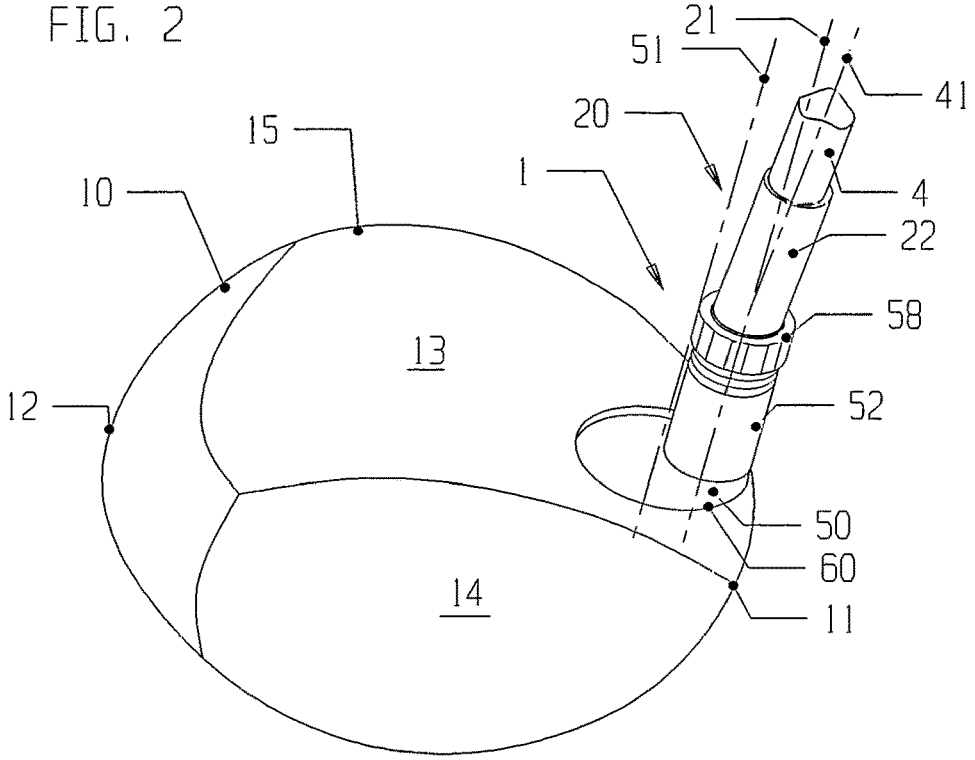
Figure 3:
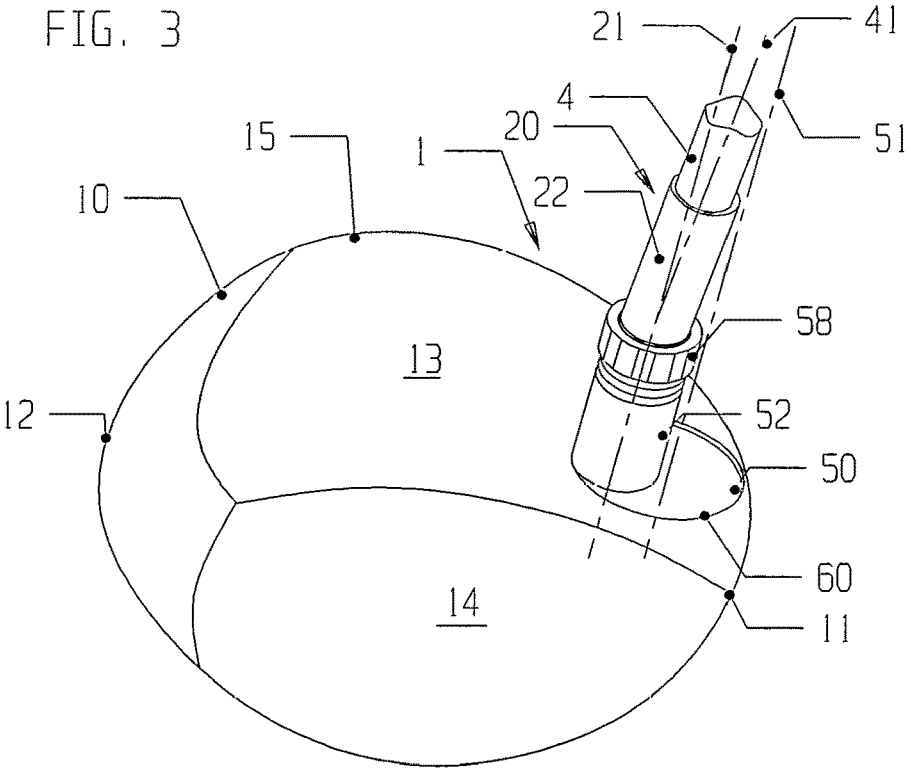
Figure 4:
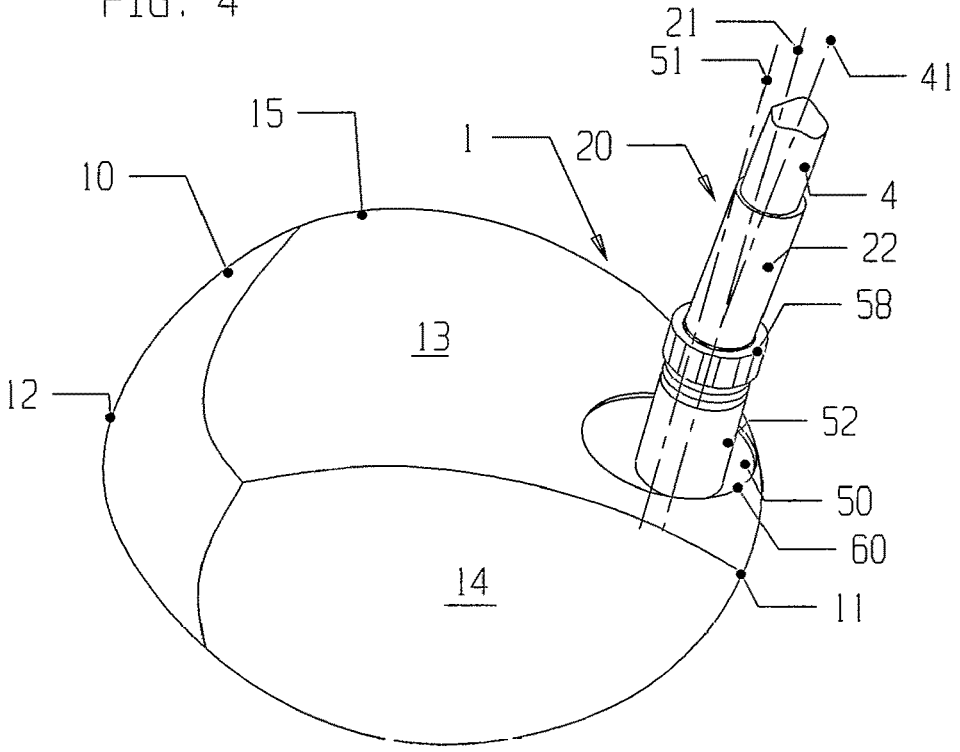
Figure 5:
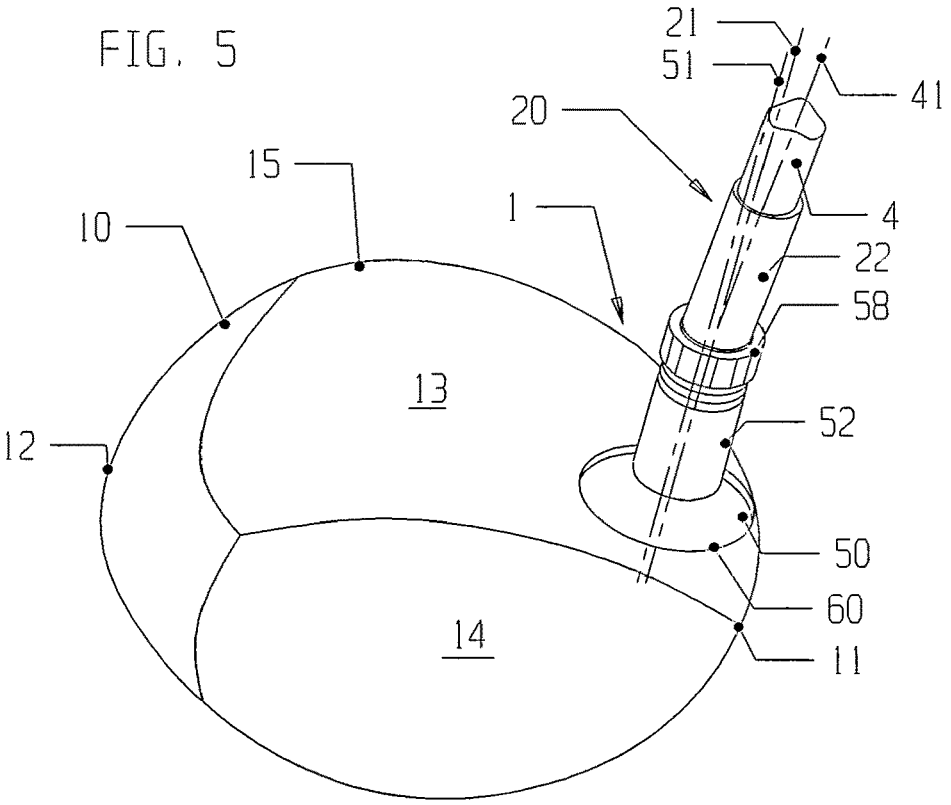

Rotator 50 can be secured in cavity 60 by the rotator connection mechanism which uses fastener 64 screwed into one of four threaded holes 62A, B, C, or D, therefore providing four indexed rotational orientations of rotator 50 with respect to axis of rotation 51. In many cases, two conditions concerning threaded holes 62A, B, C, and D are beneficial. The first condition is that they have axes which are spaced equally at 90 degree intervals with respect to axis of rotation 51, and the second condition is that the axes of two of them, for instance the axes of holes 62A and 62B, establish a plane which is substantially parallel with the face line of face 14. This second condition improves the effectiveness of rotator assembly 1 in moving reference axis 21 of shaft adapter assembly 20 with respect to the COM of head 10. If fastener 64 is screwed into hole 62A, rotator 50 places reference axis 21 of shaft adapter assembly 20 relatively close to heel 11, and this rotational orientation of rotator 50 could be called a "heel orientation" as shown in FIG. 2. If fastener 64 is screwed into hole 62B, this places axis 21 relatively close to toe 12, and this could be called a "toe orientation" as shown in FIG. 3. If fastener 64 is screwed into hole 62C, axis 21 is relatively close to face 14, and this orientation could be called a "face orientation" as shown in FIG. 4. If fastener 64 is screwed into hole 62D, axis 21 is relatively close to back 15, and this could be called a "back orientation" which is shown in FIG. 5.

The shaft adapter connection mechanism provides for a component of shaft adapter assembly 20, namely adapter fitting 22, to be secured in a plurality of rotational orientations with respect to reference axis 21. Because hosel axis 41 is skewed with respect to reference axis 21, this plurality of rotational orientations of adapter fitting 22 provides a plurality of angular orientations of head 10 with respect to hosel axis 41. Due to the multi-faceted cross-sections of the lower portion 24 of adapter fitting 22 and socket 54 in neck 52, an indexing mechanism is provided for the shaft adapter connecting mechanism. This indexing mechanism as shown in these figures has four indexed rotational orientations of adapter fitting 22 with respect to reference axis 21. Adapter fitting 22 is secured in socket 54 by screwing nut 58 onto the external threads of neck 52, thereby pushing shoulder 26 of adapter fitting 22 against neck 52. Considering discussions earlier concerning skewed axis shaft adapters, reference axis 21 of shaft adapter assembly 20 is collinear with an axis of socket 54. Reference axis 21 of shaft adapter assembly 20 is shown offset from axis of rotation 51 of rotator 50.

FIGS. 2 through 5 show rotator 50 in the four rotational orientations described above. To change from one rotational orientation to another, nut 58 is removed from neck 52 and adapter fitting 22 is removed from socket 54. Then fastener 64 is removed from its present hole 62A, B, C, or D and rotator 50 is positioned in cavity 60 in its new rotational orientation with respect to axis of rotation 51 and secured therein using fastener 64 screwed into its new hole 62A, B, C, or D. Then the lower portion 24 of adapter fitting 22 is inserted into socket 54 in one of four indexed rotational orientations with respect to reference axis 21 and secured using nut 58.

Note that using the term "axis" for axis of rotation 51 of rotator 50 does not necessarily mean "axle". The descriptor axle could be used for this first embodiment as cavity 60 and the lower portion of rotator 50 could function as an "axle" if rotator 50 was rotated with its lower portion inserted into cavity 60. But rotator 50 could be entirely removed from cavity 60 and rotated in any desired manner to its new rotational orientation in cavity 60. Saying that rotator 50 has an axis of rotation 51 simply means there is a line through rotator 50 which is substantially invariant with respect to cavity 60 and head 10 with rotator 50 secured in cavity 60 in all of its indexed rotational orientations. For this first embodiment, two conditions must be met in order for axis of rotation 51 to exist for rotator 50.

The first condition is that rotator 50 should not "wobble". Rotator 50 has a bottom surface, cavity 60 has an upward facing surface, and when rotator 50 is secured in cavity 60 in its four indexed rotational orientations, there are points of contact between these surfaces. All these points of contact must be substantially coplanar for axis of rotation 51 to exist for rotator 50. A simple construction which meets this condition is that the bottom surface of rotator 50 and the upward facing surface of cavity 60 are substantially planar.

The second condition necessary for axis of rotation 51 to exist for rotator 50 is axis 51 should be in a substantially fixed location with respect to cavity 60 regardless of which indexed rotational orientation rotator 50 is in. In these figures, cavity 60 and the lower portion of rotator 50 that is inserted in cavity 60 are shown as having circular cross-sections. To satisfy this second condition, the lower portion of rotator 50 must have a diameter only slightly smaller than the diameter of cavity 60; they must have a close-fitting relationship. Of course, circular cross-sections are not necessary in order to prevent translation of axis of rotation 51. For instance, cavity 60 could have a circular cross-section but rotator 50 could be lobed, or vice versa, or they could both be lobed if the lobes are properly located on the two components. It is only necessary that rotator 50 and cavity 60 have a close-fitting relationship whenever rotator 50 is secured in any of its four indexed rotational orientations. A simple construction which meets this condition is a circular cross-section for cavity 60 and the lower portion of rotator 50 as shown in these figures. This construction is also aesthetically pleasing in that it presents a relatively smooth surface for crown 13 and it conceals all threaded holes 62A-D.

This first embodiment has a rotator indexing mechanism due to the fact that, along with the close-fitting relationship between rotator 50 and cavity 60 discussed above, holes 62A-D are offset from axis of rotation 51 and fastener 64 passes through hole 56 which is also offset. Fastener 64 and thru hole 56 could be located in other locations with respect to axis of rotation 51. For instance, thru hole 56 could be moved in rotator 50 by rotating it 180 degrees about axis of rotation 51 and, with rotator 50 in its heel orientation shown in FIG. 2, fastener 64 could pass through it and be secured in threaded hole 62B.

In some cases, two conditions in the construction of rotator assembly 1 and shaft adapter assembly 20 are beneficial in order to allow for simple and independent adjustments to the spatial relationship and angular orientation of head 10 with respect to hosel axis 41. The first condition is that reference axis 21 of shaft adapter assembly 20 is substantially parallel with axis of rotation 51 of rotator 50. FIG. 1 shows adapter fitting 22 having four orthogonal rotational orientations with respect to socket 54 and reference axis 21, and the second condition is that, in two of them, axis 41 of hosel 40 is substantially coplanar with reference axis 21 and axis of rotation 51. This second condition is automatically met if shaft adapter assembly 20 is a straight axis shaft adapter. But if shaft adapter assembly 20 is a skewed axis shaft adapter, like the skewed fitting shaft adapter particularly shown in these figures, meeting these two conditions allows the simple and independent adjustments discussed above. For instance, with rotator 50 in its heel orientation shown in FIG. 2 and with adapter fitting 22 in a first rotational orientation in socket 54 in which hosel axis 41 meets the second condition above, if rotator 50 is rotated 180 degrees to its toe orientation shown in FIG. 3 and adapter fitting 22 is also rotated 180 degrees in socket 54, then the rotation of rotator 50 changes the spatial relationship that head 10 has with hosel axis 41 but it leaves its angular orientation substantially unchanged.

Under some conditions it may be desirable that rotator assembly 1 and shaft adapter assembly 21 not possess either or both of these conditions, and at times it may be desirable that they do possess them but it is nevertheless desirable to change the angular orientation of head 10 with respect to hosel axis 41 with a change in rotator 50 orientation. For instance, as discussed below, moving rotator 50 from its heel orientation shown in FIG. 2 to its toe orientation shown in FIG. 3 will help a golfer "close" the golf club's face at impact, meaning the face line of head 10 will be facing left of a target line for a right-handed golfer. Since golf clubs have lie angles which are not perpendicular to the ground plane, closing the face effectively reduces the loft angle of face 14. If the golfer has a loft that he likes when rotator 50 is in its heel orientation but wanted to set rotator 50 to promote a draw by rotating rotator 50 to its toe orientation, he could counteract the reduction in effective loft by placing adapter fitting 22 in socket 54 in a rotational orientation which will increase the loft angle of face 14.

Rotator assembly 1 has an ability to move reference axis 21 of shaft adapter assembly 20 and axis 41 of hosel 40 with respect to the COM of head 10. This ability is a benefit for a golfer who uses a golf club in which assembly 1 is employed in that it can be used to help him hit a draw or a fade. The following discussions will primarily discuss the relationship of the COM of head 10 with respect to reference axis 21, but they are also applicable to the relationship of the COM of head 10 with respect to hosel axis 41.

Head 10 has a first moment of mass with respect to reference axis 21 which is the mass of head 10 times a torque arm length which is a length of a line connecting the COM of head 10 perpendicularly to reference axis 21. When the golf club is accelerated in its swing, head 10 applies a torque around reference axis 21 which is affected by the first moment of mass of head 10 with respect to axis 21. In a typical driver head, for instance, its COM is located at a point which is somewhat centered horizontally on, and slightly behind, face 14 of head 10. Therefore, when rotator 50 is in its heel orientation as shown in FIG. 2, reference axis 21 of shaft adapter assembly 20 lies relatively farther from the COM of head 10 than when rotator 50 is in its toe orientation as shown in FIG. 3. Therefore, for any given golf swing, the torque applied about reference axis 21 by head 10 is greater when rotator 50 is in its heel orientation than when it is in its toe orientation. This torque causes shaft 4 to twist about its axis 41, causing face 14 of head 10 to "open" and "close" relative to the target line. It is generally accepted that a higher torque applied to shaft 4 promotes a fade and a lower torque promotes a draw.

Head 10 also has a second moment of mass with respect to reference axis 21, and it, like the first moment of mass, will be greater when rotator 50 is in its heel orientation than when rotator 50 is in its toe orientation. For any given shaft 4, the golf club's torsional frequency around axis 41 will therefore be lower when rotator 50 is in its heel orientation than when rotator 50 is in its toe orientation. A higher torsional frequency is generally believed to promote a draw and a lower torsional frequency is generally believed to promote a fade.

Defining a couple of terms will help in the following discussions. A first term is "COM plane" defined herein as a plane which is perpendicular to reference axis 21 of shaft adapter assembly 20 and which passes through the COM of head 10. A second term is axis "offset" defined herein as a length of a line which lies in the COM plane and has a first endpoint where reference axis 21 intersects the COM plane and a second endpoint where axis of rotation 51 intersects the COM plane. If reference axis 21 and axis of rotation 51 are parallel, axis offset is simply the length of a line between axes 21 and 51 which is perpendicular to them. Axis offset is a term which is beneficial in describing how effective rotator assembly 1 is in translating reference axis 21 with respect to head 10.

A USGA rule puts a limit on how far rotator assembly 1 can move axis 41 of hosel 40 with respect to heel 11. This rule states that, "except for putters, all of the heel portion of the club must lie within 0.625 inches (15.58 mm) of the plane containing the axis of the straight part of the shaft and the intended (horizontal) line of play". This rule means that axis 41 must never be farther than 15.58 mm (0.625") from heel 11 measured as described in the rule, and this puts a design restraint on rotator assembly 1 if it is to comply.

With holes 62A and 62B oriented as discussed above wherein their axes establish a plane which is substantially parallel with the face line of face 14, as a practical matter, an axis offset for rotator 50 of at least 4.4 mm (0.175 inches) is attainable while still complying with this USGA rule. Therefore, a rotation of rotator 50 from its heel orientation as shown in FIG. 2 to its toe orientation as shown in FIG. 3 changes the torque arm length of the COM of head 10 with respect to reference axis 21 by approximately a distance equal to two times the axis offset of rotator 50, or 8.8 mm (0.35 inches). A typical driver head has a total mass of about 200 grams. Therefore, moving reference axis 21 by 8.8 mm (0.35") approximately along the torque arm of the COM with respect to reference axis 21 results in an approximate change in the first moment of mass of head 10 with respect to reference axis 21 of 1760 gram-mm (70 gram inches). A popular driver head in use today uses a sliding weight in a track to change the position of its COM. The sliding weight has a mass of 15 grams and it can be moved such that it changes the torque arm length of the COM with respect to its skewed axis shaft adapter's reference axis by approximately 38 mm (1.5 inches). This moveable weight scheme therefore has an ability to change the first moment of mass of its head about its shaft adapter's reference axis approximately 570 gram-mm (22.5 gram-inches). Comparing these numbers shows the effectiveness of assembly 1 in changing the mass distribution properties of head 10 with respect to axis 21. Assembly 1 functions by moving reference axis 21 with respect to head 10 which has a fixed COM, whereas moveable weight systems in use today function by moving the head's COM with respect to the head with a fixed reference axis location.

In light of the above discussion, the heel orientation of rotator 50 shown in FIG. 2 could also be called a "high moment of mass orientation" and its toe orientation shown in FIG. 3 could be called a "low moment of mass orientation". The face and back orientations shown in FIGS. 4 and 5 respectively could be called "intermediate moment of mass orientations" because, when rotator 50 is one of these two rotational orientations in cavity 60, the first and second moments of mass lie between the values they have when rotator 50 is in its high moment of mass orientation and when rotator 50 is in its low moment of mass orientation.

Another difference between the four rotational orientations of rotator 50 as shown in FIGS. 2-5 concerns a property discussed above which is face progression. The golf club's face progression will be least when rotator 50 is in its face orientation as shown in FIG. 4, it will be greatest when rotator 50 is in its back orientation as shown in FIG. 5, and it will have an intermediate value when rotator 50 is in either its heel orientation or its toe orientation as shown in FIGS. 2 and 3 respectively. Increasing a golf club's face progression is generally believed to promote a draw and decreasing its face progression is believed to promote a fade.

Another useful feature resulting from using rotator assembly 1 in combination with shaft adapter assembly 20 concerns asymmetry in shaft 4 discussed above. It was pointed out that some feel there are orientations of shaft 4 with respect to head 10 which are preferred. If shaft 4 is in a preferred orientation with rotator 50 in a first rotational orientation and if shaft 4 is solidly secured in neck 52, if rotator 50 is rotated from a first rotational orientation to a second, shaft 4 may no longer be in its preferred orientation. Using shaft adapter assembly 20 in combination with rotator assembly 1, however, allows independent adjustments in the rotational orientation and in the position of shaft 4 with respect to head 10.

Description and Operation—FIGS. 6 and 7—Shaft Adapter Rotator, Second and Third Embodiments FIG. 6 shows a second embodiment of an apparatus which comprises a rotator assembly 1' and which is used in securing golf shaft 4 to a head 10'. Most items shown in FIG. 6 are identical to those shown in FIGS. 1-5 with a few exceptions. Head 10' is similar to head 10 except it has a cavity 60' having a multi-faceted (four-sided) cross-section instead of the circular cross-section of cavity 60. FIG. 6 also shows a rotator 50' having a lower portion with a cross-section similarly shaped to that of cavity 60' and which has a close-fitting relationship with cavity 60'. Also, fastener 64 is shown positioned with its axis substantially collinear with axis of rotation 51 and it passes through an axial hole (not shown) in rotator 50' and is secured in an axial threaded hole (not shown) in cavity 60'. This second embodiment has a rotator connection mechanism comprising cavity 60', the lower portion of rotator 50', and fastener 64. The rotator connection mechanism restricts translation of axis of rotation 51 because of the close-fitting relationship between cavity 60' and the lower portion of rotator 50' when rotator 50' is in all of its allowed orientations with respect to axis of rotation 51, and it provides an indexing mechanism because of the multi-faceted cross-sections of cavity 60' and the lower portion of rotator 50'.

FIG. 7 shows a third embodiment of an apparatus which comprises a rotator assembly 1" and which is used in securing golf shaft 4 to a head 10". Most items shown in FIG. 7 are identical to those shown in FIGS. 1-5 with a few exceptions. Head 10" of FIG. 7 is similar to head 10 except head 10" does not have a cavity such as cavity 60 in head 10. FIG. 7 shows a rotator 50" which has two thru hole's (not shown) through which a pair of fasteners 64 pass to be secured in two of a plurality of threaded holes (not shown) in head 10". These threaded holes can be located in head 10" similarly to holes 62A-D shown in FIG. 1. This third embodiment has a rotator connection mechanism comprising fasteners 64, the thru holes in rotator 50", and the plurality of threaded holes in head 10". This embodiment's rotator connection mechanism restricts translation of axis of rotation 51 because the holes in rotator 50" have a close-fitting relationship with fasteners 64, and it provides an indexing mechanism due to the use of two fasteners 64.

CONCLUSION, RAMIFICATIONS, AND SCOPE

Accordingly, the reader will see that herein described are several embodiments of an apparatus which is used to secure a shaft to a golf club head. The apparatus comprises a rotator, a shaft adapter, a rotator connection mechanism to secure the rotator to the golf club head, and a shaft adapter connection mechanism to secure a shaft adapter to the rotator. The apparatus is able to change the head's mass distribution properties with respect to a reference axis of the shaft adapter by translating the reference axis with respect to the head. Under a first condition that the shaft adapter is a skewed axis shaft adapter and a second condition that the shaft adapter's reference axis is parallel with an axis of rotation of the rotator, the apparatus can be used to adjust the head's mass distribution properties with respect to the shaft adapter's reference axis and the head's angular orientation with respect to an axis of the shaft. Indexing mechanisms can be included which urge the rotator and a component of the shaft adapter to remain in a plurality of indexed rotational orientations with respect to axes of their respective connection mechanisms.

Although the description above contains many specificities, these should not be construed as limiting the scope of the invention but as merely providing illustrations of it. The embodiments shown have four indexed rotational orientations for the rotator and the shaft adapter, but other numbers of them could be provided such as two or eight. Also, the rotator and the shaft adapter can have different numbers of indexed positions, such as four for the rotator and eight for the shaft adapter. Also, other rotator and shaft adapter connection mechanisms are envisioned such as ones which use a fastener which passes upwardly through a hole in the head to be screwed into a threaded hole in the rotator or the shaft adapter's fitting. Also, the drawings show a shaft adapter assembly which is of the skewed fitting type, but in some cases use of a skewed shim shaft adapter or a straight axis shaft adapter might be desired which could be accomplished by one skilled in the art. The scope of the invention should be determined by the appended claims and their legal equivalents rather than by the examples given.

I claim:

1. An apparatus which secures a shaft to a head of a golf club, the apparatus comprising:

a rotator, a skewed axis shaft adapter, a rotator connection mechanism, and a shaft adapter connection mechanism, wherein the rotator is secured to the head by the rotator connection mechanism which provides for the rotator to be secured, with respect to an axis of rotation, in a plurality of rotational orientations, wherein the skewed axis shaft adapter is secured to the rotator by the shaft adapter connection mechanism which provides for the skewed axis shaft adapter to be secured, with respect to a reference axis, in a plurality of rotational orientations, wherein the shaft adapter connection mechanism secures the skewed axis shaft adapter to the rotator with the reference axis substantially parallel with, but offset from, the axis of rotation, and wherein the shaft is secured in a hosel of the shaft adapter, whereby the apparatus, by providing for the rotator to be secured in its plurality of rotational orientations, provides for the shaft adapter's reference axis to have, with respect to the head, a plurality of positions, and whereby the apparatus, by providing for the skewed axis shaft adapter to be secured in its plurality of rotational orientations, provides for the head to have, with respect to an axis of the hosel, a plurality of angular orientations.

2. The apparatus of claim 1 wherein the rotator connection mechanism has an indexing mechanism which urges the rotator to remain in a plurality of indexed rotational orientations and the shaft adapter connection mechanism has an indexing mechanism which urges the skewed axis shaft adapter to remain in a plurality of indexed rotational orientations.

3. The apparatus of claim 2 wherein the rotator has first and second indexed rotational orientations and the axis of rotation, the reference axis with the rotator in the first indexed rotational orientation, and the reference axis with the rotator in the second rotational orientation are substantially coplanar.

4. The apparatus of claim 3 wherein the skewed axis shaft adapter has first and second indexed rotational orientations and an axis of the hosel with the skewed axis shaft adapter in the first rotational orientation and the axis of the hosel with the skewed axis shaft adapter in the second rotational orientation are substantially coplanar with the axis of rotation, the reference axis with the rotator in the first rotational orientation, and the reference axis with the rotator in the second rotational orientation, whereby the head's mass distribution properties with respect to the hosel's axis can be adjusted while leaving substantially unchanged the head's angular orientation with respect to the hosel's axis.

5. The apparatus of claim 1 wherein the apparatus, by providing the rotator's plurality of rotational orientations, provides for the golf club to have a plurality of face progressions.

6. The apparatus of claim 1 wherein the skewed axis shaft adapter is categorized as being a skewed fitting shaft adapter.

7. The apparatus of claim 1 wherein the skewed axis shaft adapter is categorized as being a skewed shim shaft adapter.

8. An apparatus which secures a shaft to a head of a golf club, the apparatus comprising:

a rotator comprising a rotator axis of rotation, a rotator connection mechanism, a shaft adapter comprising a hosel, a reference axis, and a component which skews an axis of the hosel with respect to the reference axis, and a shaft adapter connection mechanism, wherein the rotator connection mechanism secures the rotator to the head and provides for the rotator to have a plurality of possible rotational positions with respect to the rotator axis of rotation, wherein the shaft adapter connection mechanism secures the shaft adapter to the rotator with the reference axis substantially parallel with, but offset from, the rotator axis of rotation and provides for the component to have a plurality of possible rotational positions with respect to the reference axis, wherein the shaft is secured in the hosel, whereby the apparatus provides for the reference axis to have a plurality of possible positions with respect to the head, thereby providing for the head to have a plurality of possible mass distributions properties with respect to the reference axis.

9. The apparatus of claim 8 wherein the shaft adapter connection mechanism can secure the shaft adapter to the rotator irrespective of the rotator being secured to the head.

10. The apparatus of claim 8 wherein the rotator connection mechanism has an indexing mechanism which urges the rotator to remain in a plurality of indexed rotational orientations.

11. The apparatus of claim 10 wherein the rotator has a first indexed rotational orientation and a second indexed rotational orientation which is substantially 180 degrees from the first, and wherein the first and second rotational orientations are positioned with respect to the head such that a plane substantially established by the shaft adapter's reference axis when the rotator is in its first and second indexed rotational orientations is substantially parallel with a face line of the head.

12. The apparatus of claim 8 wherein the component's possible rotational positions are indexed.

13. An apparatus used to secure a shaft to a head of a golf club, the apparatus comprising:

a rotator, a shaft adapter comprising a hosel, a rotator connection mechanism, and a shaft adapter connection mechanism, wherein the rotator connection mechanism provides for the rotator to be secured to the head, the shaft adapter connection mechanism provides for the shaft adapter to be secured to the rotator, and the hosel provides for the shaft to be secured to the shaft adapter, wherein the rotator connection mechanism further provides for the rotator to have a plurality of possible rotational positions with respect to a rotator axis of rotation, wherein the shaft adapter further comprises a component which has a plurality of possible rotational positions with respect to a component axis of rotation which, when the shaft adapter is secured to the rotator, is substantially parallel with, but offset from, the rotator axis of rotation, wherein the component provides for an axis of the hosel to be skewed with respect to the component axis of rotation, whereby the apparatus provides for the component axis of rotation to have a plurality of positions with respect to the rotator's axis of rotation, thereby providing for the head to have a plurality of sets of mass distribution properties with respect to the component axis of rotation.

14. The apparatus of claim 13 wherein the component axis of rotation is a reference axis of the shaft adapter.

15. The apparatus of claim 13 wherein the rotator comprises a socket and the shaft adapter connection mechanism provides for the shaft adapter to be secured in the socket.

16. The apparatus of claim 15 wherein the component is a skewed axis fitting and the shaft adapter connection mechanism provides for the skewed axis fitting to be secured in the socket.

17. The apparatus of claim 13 wherein the component is a skewed shim.

18. The apparatus of claim 13 wherein the plurality of possible rotational positions of the component with respect to the component axis of rotation provides for the hosel's axis to have a plurality of angular orientations with respect to the head, thereby providing for the head to have a plurality of sets of angular properties with respect to the hosel's axis.

19. The apparatus of claim 13 wherein the shaft adapter is categorized as being a skewed fitting skewed axis shaft adapter.

20. The apparatus of claim 13 wherein the shaft adapter is categorized as being a skewed shim skewed axis shaft adapter.

* * * * *